US005392929A

United States Patent [19]

Breach

[11] Patent Number: 5,392,929

[45] Date of Patent: Feb. 28, 1995

[54] METHOD AND APPARATUS FOR SORTING BY SIZE

[76] Inventor: John R. Breach, Chittenden Orchard, Staplehurst, Tonbridge, Kent TN12 OEX, England

[21] Appl. No.: 30,125

[22] PCT Filed: Sep. 24, 1991

[86] PCT No.: PCT/GB91/01639

§ 371 Date: May 10, 1993

§ 102(e) Date: May 10, 1993

[87] PCT Pub. No.: WO92/05883

PCT Pub. Date: Apr. 16, 1992

[30] Foreign Application Priority Data

Oct. 1, 1990 [GB] United Kingdom ..... 9021353

[51] Int. Cl.[6] ..... B03B 5/00; B03B 5/62

[52] U.S. Cl. ..... 209/659; 209/156; 209/208; 209/209

[58] Field of Search ..... 209/156, 208, 209, 210, 209/173, 162, 170, 659

[56] References Cited

U.S. PATENT DOCUMENTS

| | | |
|---|---|---|
| 1,186,677 | 6/1916 | Parker . |
| 1,209,900 | 12/1916 | Stebler . |
| 1,252,833 | 1/1918 | Parker . |
| 1,286,554 | 12/1918 | Dekker . |
| 1,885,988 | 11/1932 | Chapman . |
| 2,035,118 | 3/1936 | Falkiner . |
| 2,234,502 | 3/1941 | Pixton . |
| 2,262,465 | 11/1941 | Olney . |
| 2,283,512 | 5/1942 | Sias ..... 209/173 |
| 2,501,909 | 3/1950 | Olney . |
| 2,571,056 | 10/1951 | Olney . |
| 2,590,756 | 3/1952 | Colin . |
| 3,031,081 | 4/1962 | Belk . |
| 3,337,049 | 8/1967 | Carlsen . |
| 3,364,035 | 1/1968 | Belk . |
| 3,568,839 | 3/1971 | Dunlea, Jr. . |
| 3,701,565 | 10/1972 | Gutlerman . |
| 3,702,656 | 11/1972 | Gutlerman . |
| 3,822,015 | 7/1974 | Hsieh . |
| 4,245,553 | 1/1981 | Nakamura . |
| 4,946,584 | 8/1990 | Olney . |
| 5,039,534 | 8/1991 | Adams . |
| 5,048,693 | 9/1991 | Zaltzman . |

FOREIGN PATENT DOCUMENTS

| | | |
|---|---|---|
| 547648 | 2/1922 | France . |
| 1427779 | 12/1964 | France . |
| 2340143 | 2/1976 | France . |
| 2515991 | 5/1983 | France . |
| 2671988 | 7/1992 | France . |
| 218353 | 7/1924 | United Kingdom . |
| 2021443 | 12/1979 | United Kingdom . |
| 776593 | 11/1980 | U.S.S.R. . |
| 902712 | 2/1982 | U.S.S.R. . |

*Primary Examiner*—Thomas M. Lithgow
*Attorney, Agent, or Firm*—James D. Hall

[57] ABSTRACT

Articles, such as apples, to be sorted by size, float in water along a main channel. Depending upon the depths to which the apples penetrate below the surface of the water, the apples may be diverted into one of a plurality of side channels by endless belts positioned at respectively different depths beneath the surface of the water.

8 Claims, 1 Drawing Sheet

METHOD AND APPARATUS FOR SORTING BY SIZE

This invention relates to a method and apparatus for sorting articles by size in liquid.

There is a need in the fruit industry for a sorter of simple construction which will reliably sort apples according to size without causing excessive damage. In USSR patent No. 776593 there is disclosed a sorter in which articles to be sorted are dropped into a moving body of water. The water at different depths moves in laminar flows at different speeds, the speeds of the flows increasing with depth.

Articles of greater density descend to greater depths and are swept further along before returning to the surface. Barriers lying in the surface trap the articles as they return to the surface, and separate them according to their density. Satisfactory sorting depends on the ability to provide laminar flows of water travelling at accurately defined speeds.

SUMMARY OF THE INVENTION

According to one aspect of the present invention there is provided a method of sorting articles by size in liquid, characterised in that floating articles are sorted according to the depths to which they penetrate below the surface of the liquid.

According to another aspect of the invention there is provided sorting apparatus including a container for liquid, means for causing articles to travel through the container, and at least one barrier disposed within the container, characterised in that the or each barrier has an upper surface portion positioned so as to lie at a predetermined depth beneath the surface of liquid in the container so as to make contact with articles floating in the liquid and penetrating at least to that depth.

When apples are to be sorted it will be convenient to use water as the liquid. It may, however, be preferable to sort some other types of fruit in brine, while other liquids may be used for other articles.

Preferably the apparatus includes a number of barriers, each including a horizontally extending moving belt for diverting articles from a main channel into a respective branch channel. Alternatively, there may be a single barrier, which may take the form of a wide band travelling in the direction transversely of the main channel. The upper surface of the upper run of the band decreases in depth in the downstream direction so that articles come to rest upon it in positions determined by their size.

DETAILED DESCRIPTION OF THE INVENTION

Figure 1:
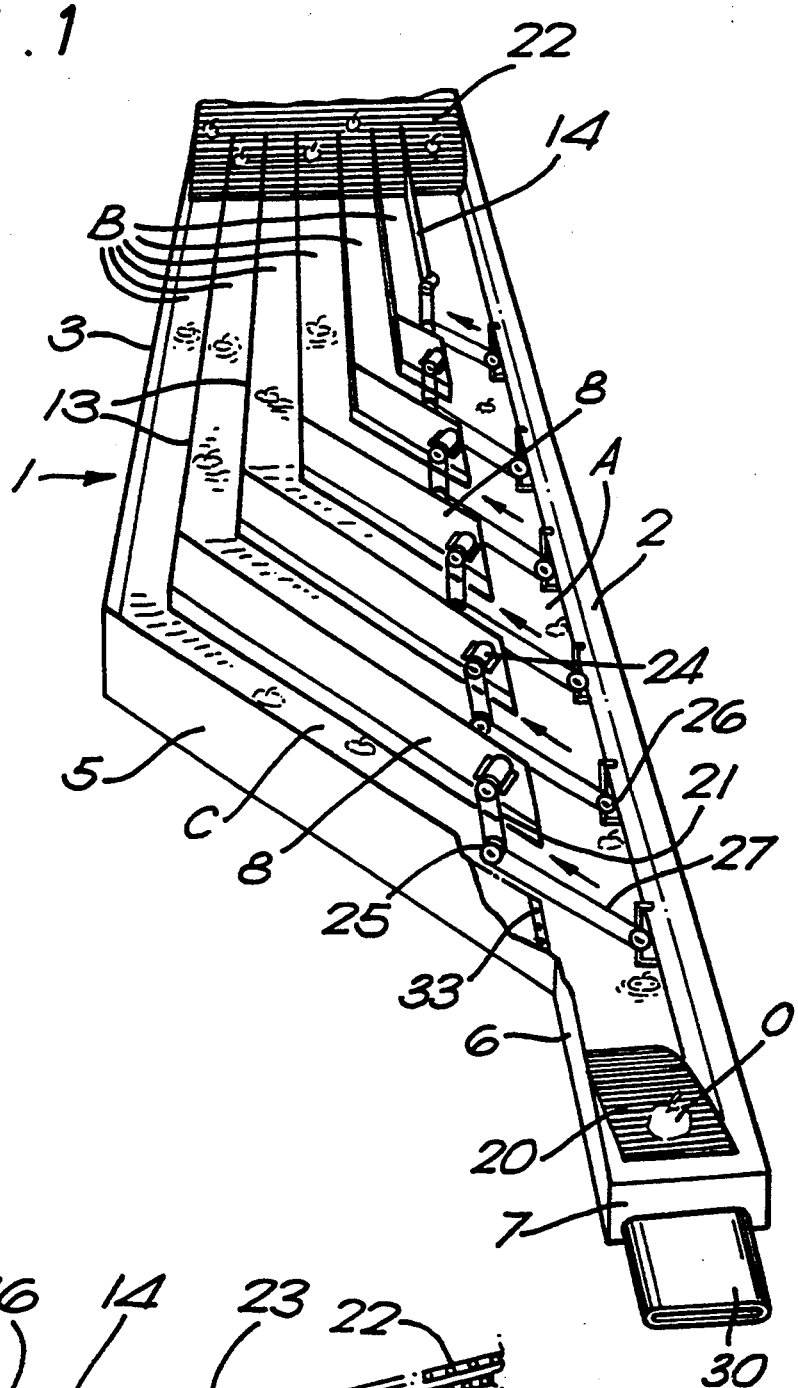
FIG. 1 is a perspective view of the preferred apparatus, in which the end of the apparatus nearer to the observer is the upstream end and that furthest from the observer the downstream end.
Figure 2:
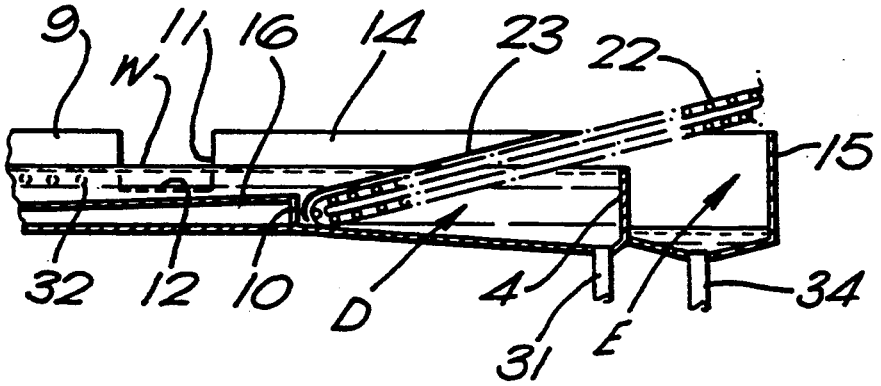
FIG. 2 is a vertical section taken longitudinally of the main channel, showing the entrance to one branch channel and the exit elevator conveyor.

Referring to the drawings, a sorter particularly for apples includes a container 1 for water. The container may be in the form of a metal bath having parallel side walls 2 and 3, a downstream end wall 4 and an upstream oblique wall 5, shown partially broken away. The wall 5 is at an angle of about 150° to wall 3. A narrow entry section is formed between an end portion of side wall 2, a wall 6 adjoining wall 5, and an upstream end wall 7. Disposed within the container is a series of spaced apart elongate casings 8 which extend parallel to-the wall 5.

The casings may be formed by pressing up the bottom of the bath or may be separate components fixed in place. The casings 8 terminate at their ends nearer to the wall 2 in walls 9. In line with the walls 9, and spaced from the casing depicted furthest from the observer is a wall 14. The walls 9 and walls 6 and 14 define with the wall 2 a main channel A. The walls 9 define with one another and with the wall 6 and wall 14 six outlets 11 from the main channel. The outlets 11 are less deep than the channel A, being provided with thresholds 12 extending to the base of channel A. Interposed between the walls 3 and 14, and extending parallel thereto are five walls 13, each of which at its upstream end forms that end wall of a respective casing remote from its wall 9. The walls 13 define with one another and with the walls 3 and 14 a group of six branch channels B extending parallel to the main channel A, and communicating therewith by way of the outlets 11. In the case of the five channels nearer the wall 3, the branch channels include obliquely extending channel portions C, each of which is defined between the longer sides of two adjacent casings or (in the case of the secondary channel nearest to the observer) between the wall 5 and the adjacent casing. The bases of channel portions C are below the upper edges of thresholds 12.

A low wall 10 extends between the walls 2 and 3 at right angles thereto in order to define with the wall 4 a sump D. In the case of that part of the bath which defines the channel portions B and C, the bottom of the bath upstream of wall 10 is horizontal and adjoins the upper edge of that wall. The bottom of the part of the bath which defines channel A upstream of wall 10 is lower and adjoins the base of that wall.

Channel A is provided with an adjustable false floor 16 which is inclined upwards in the downstream direction and which, at its downstream end terminates in the region of the upper edge of wall 10. The wall 4 defines the downstream end of the sump D and serves as a weir over which water may flow into a trough E defined between wall 4 and a further wall 15.

An entry conveyor 20 descends into the entry section of the bath between the walls 2 and 6, and overlies the upstream end wall 7 of this section. An exit elevator conveyor 22 extends the full width of the bath at its downstream end and descends into the space formed by the sump D. Both conveyors are of such construction as to allow the free passage of water through them, and may be of slatted or roller construction.

The walls 13 and 14 are cut-away on their undersides as at 23 so as to overlie the conveyor 22. Fences, not shown, may serve to continue the walls 13 and 14 along all or some of the length of the conveyor, or other means may be provided for keeping sorted apples separate.

Mounted on respective upper surfaces of the casings 8 and on the upstream end of the wall 14 are six electric motors 24, each motor driving a pulley wheel. Circuitry for energising the motors 24 and pumps referred to hereinafter is also provided. A pair of rotationally coupled pulleys 25 is supported on a shaft mounted within each branch channel below the respective motor, just within the channel at its upstream end. A return pulley 26 is supported on the wall 2. The shafts of pulleys 25 and 26 are adjustable in the vertical direction, suitable guides carried by the casings 8, wall 14 and wall 2 and releasable fixing means, being provided for this purpose. A drive belt 21 is trained over the motor pulley and the pulley of the pulley pair 25 nearer the casing or wall 14, as the case may be. A guide belt 27 is trained over the return pulley 26 and the other pulley of the pulley pair 25. When the motors are energised, the upper runs of belt 27 are caused to move in the direction indicated by the arrows. Suitable deflectors (not shown) may be provided to prevent apples to be sorted fouling the guides for the pulleys.

In use, the bath is filled with water to the level W, defined by the height of wall 4. Water is constantly supplied through an inlet duct 30 in the upstream end wall 7 and drawn off through outlets 31 in the sump D. The rate at which water enters the bath is somewhat greater than the rate at which it is removed through outlets 31 to ensure that the wall 4 acting as a weir maintains the desired level. The water passing over the weir is collected in trough E and drawn off through outlets 34. A flow of water is therefore established within the bath, along the length of each of the channels. The end wall 9 of each casing facing the wall 2 is provided with jets 32. Jets 33 in each threshold 12 directed away from the main channel assist in establishing flow into each branch channel in the region of the entrance. The provision of the false floor 16 ensures that flow along the main channel is maintained at approximately constant speed throughout its length, despite diversion of a proportion of the flows into the branch channels. Separate pumps, not shown, recirculate the water escaping through outlets 31 and 34, supplying the water through a system of pipes to the inlet 30 and to jets 32 and 33, respectively.

Apples O or other articles to be sorted placed onto the entry conveyor 20 are deposited in the water in the entry section of the main channel and float along the main channel adjacent to wall 2. The pulleys 25 and 26 have previously been adjusted in height relative to the water level such that the upper run of each belt 27 is horizontal and at such a distance below the water surface that it will make contact with apples floating in the water and penetrating to a predetermined depth. The depth of the upper run of each belt after the first is less than that of the preceding one in the upstream direction. The largest apples encounter the most upstream belt, the next largest encounter the next adjacent belt, and so on, while apples which are smaller than the predetermined minimum size pass over all of the belts and continue along the main channel.

The water issuing from the jets 32 causes the apples to float adjacent wall 2, so that they will only enter the desired outlet 11 to a branch channel under propulsion from the associated belt. The water emerging from the jets 33 helps ensure that once apples have been propelled into an outlet by the associated belt they will continue along the branch channel reliably, rather than accumulate in the entrance. The continuous flow of water along the channels brings the apples onto the exit elevator conveyor, which lifts them out of the water and conveys them in seven lines through stations at which they are rinsed, dried in an air current and then removed and packed.

Modifications may be made to the illustrated arrangement. Thus, for example, the upper surface of each of the belts 27 when viewed in cross section may be linear and disposed horizontally, or at an angle to the horizontal, or the upper surface may be curvilinear. The belt may be of one piece construction, or of composite construction so as to facilitate the provision of a surface with a sufficient coefficient of friction. Provided a sufficient rake is provided, stationary barriers may be used in place of the belts 27. Alternatively, the barriers may include rotating rollers, vibrating bristles or fingers. There may be two or more barriers at the same depth. All of the barriers at the same depth may feed into one and the same branch channel or into respective branch channels.

In a further modification, a single endless belt may be employed in the form of a wide band, the upper run of which decreases in depth in the downstream direction so that the articles land on it at different distances from its upstream edge, depending upon the sizes of the articles. The band travels in a direction at right angles to the flow direction. The band may be provided with cup-shaped depressions or with ribs so as to convey the articles reliably out of the flow stream. Instead of using pumps to produce circulation of liquid, paddles may be used to circulate water around a closed loop.

The widths of the channels may be slightly greater than the diameters of the articles to be sorted so as to ensure that the articles arrive on the elevator 22 from each channel in single file.

Although the articles are shown to travel through the tank under the effect produced by a moving current of liquid, it falls within the scope of the invention for the liquid to be still and for other means to be provided for propelling the articles. Such means may, for example, take the form of moving fingers contacting the articles, or jets of air. It will also be appreciated that the invention may be applied to articles floating in a naturally flowing body of water, so that no container or tank as such is provided in order to retain the water. Although it is preferred to fabricate the bath from metal, it may be moulded from fibre glass material or from plastics, or constructed from wood or other materials and have a water impervious lining.

The wall 4 which serves as a weir may be adjustable in height so as to allow the water level to be varied and one or more additional weirs may be provided in wall 2 so as to reduce the effect of turbulence in the flow along channel A. The liquid escaping from the additional weirs may be led to trough E.

I claim:

1. Apparatus for sorting buoyant articles floating on the surface of a liquid, comprising:

a container for the liquid, said container having a bottom, a first substantially straight vertical side wall, a plurality of second substantially straight vertical side walls obliquely disposed with respect to the first side wall and each of said second side walls having a first end spaced a substantially uniform distance from said first wall so as to define therewith an open-topped main channel extending horizontally in a longitudinal direction of the first vertical side wall, and coextensive therewith, said container having an upstream end at a first end of said first sidewall and a downstream end at a second end of said first sidewall;

said second side walls extending substantially parallel to each other and spaced apart from one another to define therebetween a plurality of outlets from the main channel;

a plurality of third vertical walls each attached to a second end of a corresponding second sidewall, said third vertical walls and said second vertical sidewalls defining a plurality of open-topped branch channels, each branch channel extending horizontally and opening through a respective one of said outlets into the main channel;

said further walls defining portions of the branch channels which extend horizontally parallel to the main channel;

a plurality of relatively narrow endless belts, each said belt having a horizontal upper run extending across the main channel at a position adjacent the downstream edge of a respective outlet;

means for causing said belts to circulate such that the upper run of each belt travels in the direction away from said first wall towards a corresponding said outlet;

means for supplying and removing liquid from the container and establishing a predetermined liquid level in each channel of the container above the upper runs of said belts, all of said levels being in substantially the same plane;

means for adjusting the height of the upper runs of said endless belts relative to the bottom of the container, thereby to position each belt upper run at a predetermined depth beneath the predetermined liquid level the depths of said upper runs below the predetermined liquid level decreasing in the downstream direction;

means for causing liquid to flow from the upstream end of said main channel to the downstream end of said main channel, and from each outlet thereof along each of said branch channels to a downstream end of each of said branch channels;

means for introducing articles to be sorted into the upstream end of the main channel;

means for removing sorted articles from the downstream end of said main channel and from each of said branch channels;

2. The sorting apparatus of claim 1, wherein each said endless belt is drivingly connected to a respective motor.

3. The sorting apparatus of claim 2, further including jets disposed in the second side walls for discharging liquid into said main channel to cause articles floating therein to be displaced from the second wall.

4. The sorting apparatus of claim 3, further including jets associated with each outlet and directed into a branch channel and away from said main channel.

5. The sorting apparatus of claim 4, wherein said means for introducing and removing articles each comprise conveyor belts which extend to positions below the liquid level.

6. A method of sorting different sizes of buoyant articles by size wherein the articles to be sorted float in the surface of a liquid, the larger articles having portions which are disposed at levels below the surface of the liquid deeper than portions of the smaller articles, all of the articles being made to float in the liquid surface along a main channel having a feed end and a discharge end spaced therefrom, said method including the steps of:

providing in said main channel first and second distinct, individually vertically adjustable, endless belt conveyors, each belt conveyor spaced from the other and oriented to convey a given sized article out of said main channel, said first belt conveyor located upstream in said main channel and being closer to said feed end of the main channel than said second belt conveyor, said first belt conveyor being located at a first predetermined depth in said main channel that is deeper than a second predetermined depth at which said second belt conveyor is located;

feeding the buoyant articles of different sizes into the main channel;

sorting the articles of a larger size by contacting the larger size articles against said upstream first belt conveyor positioned beneath the surface of the liquid at said first predetermined depth;

deflecting the larger size articles by the first belt conveyor to one side of the main channel and into a first secondary channel while still floating in the liquid surface;

floating the articles of a medium size and smaller size that do not encounter the first belt conveyor over the first belt conveyor to continue along the main channel;

sorting the articles of a said medium size by contacting the medium size articles against said second belt conveyor positioned beneath the surface of the liquid at said second predetermined depth which is less than said first predetermined depth;

deflecting the articles of said medium size articles by said belt conveyor into a second secondary channel while still floating in the liquid surface; and floating the smaller articles which do not encounter the second conveyor over the second conveyor to continue along the main channel.

7. The method of claim 6, wherein said first and second belt conveyors move horizontally across the main channel and carry with them those articles which encounter the respective first and second belt conveyors.

8. The method of claim 6, further comprising the step of directing a jet of liquid from an inlet of each of said secondary channels into the secondary channels to thereby assist in directing the articles into the secondary channels.

* * * * *